United States Patent [19]

Wohl

[11] Patent Number: 4,900,031

[45] Date of Patent: Feb. 13, 1990

[54] BOARD GAME

[76] Inventor: Kenneth A. Wohl, 14911 Ben Ali, San Antonio, Tex. 78248

[21] Appl. No.: 302,989

[22] Filed: Jun. 1, 1989

[51] Int. Cl.[4] ..... A63F 3/00; A63F 9/18

[52] U.S. Cl. ..... 273/243; 273/272

[58] Field of Search ..... 273/240, 243, 272, 299

[56] References Cited

U.S. PATENT DOCUMENTS

| | | | |
|---|---|---|---|
| 3,984,106 | 10/1976 | White | 273/243 |
| 4,592,553 | 6/1986 | Mammen et al. | 273/240 |
| 4,682,777 | 7/1987 | Wood | 273/243 |

*Primary Examiner*—Benjamin Layno

*Attorney, Agent, or Firm*—Gunn, Lee & Miller

[57] ABSTRACT

The invention is a method for playing a board game wherein players attempt to control positions on a segmented path, demarcated on a game board, by properly naming the first and last names of a famous person whose first and last initials correspond to the letters revealed on cards from two appropriate decks. Players may challenge an opposing player's choice of famous names, potentially preventing that player from obtaining control of a position, and may also compete for control of a position already under the control of another player. The method of play proceeds for a specified length of time after which the player with the most points resulting from control of board positions is declared the winner.

4 Claims, 1 Drawing Sheet

BOARD GAME

BACKGROUND OF THE INVENTION

1. Field of the Invention

The present invention relates generally to a method for playing a board game and more specifically to a method which involves testing the players' knowledge of the first and last names of famous people.

2. Background Information

There are a number of U.S. Patents for board games, many of which involve movement around a path on the board, the use of cards to help control the play, and the testing of each players knowledge of a particular subject.

U.S. Pat. No. 3,984,106 for example requires players to create words based upon their position on the board, a role of dice, and a set of numbered or lettered cards. From these three variables players are given the first letter of the word and the number of letters in the word.

The method of play in U.S. Pat. No. 4,682,777 likewise involves board positioning and a set of cards. In this case however, the players are asked to give the word when a definition is read and are allowed to control a position on the board if they answer correctly.

U.S. Pat. No. 4,592,553 is not a board game but does disclose the use of lettered dice to control the choice of words in various categories, and awards the player who is able to write down the most appropriate words.

The present invention adds a dimension not found in the above described games by including two decks of lettered cards which together control a player's answer. Having two decks narrows the number of possible answers that a player may give and at the same time increases the number of possible combinations that provide the starting initials for a possible answer. The present game is simpler than most of the above described games because answers are limited to the names of famous people and at the same time is more versatile and interesting than most of the above games because players have a greater number of possible starting points for their answers.

SUMMARY OF THE INVENTION

It is an object of this invention to provide a method for playing a board game that combines knowledge, skill, and chance in a simple yet interesting competition between players.

It is another object of this invention to provide a method for playing a board game that tests a player's knowledge of famous people.

It is another object of this invention to provide a method for playing a board game wherein players are generally in competition with each other at all times and specifically in competition one on one in certain circumstances during the play of the game.

It is a further object of this invention to provide a method for playing a board game wherein players may challenge opposing players on the correctness of their play, and may resolve such challenges by way of a definitive source book.

To achieve these and other related objectives this invention provides a game method wherein players in turn move tokens around the board according to the throw of a die and attempt to control positions on a path around the board by recalling the name of a famous person whose first and last initials are given by letters on the top cards in two appropriate decks. Upon recalling a famous name the player may either take control of the position upon which his token rests or be challenged by an opposing player on the accuracy of his answer. This invention additionally provides for the exchange of control of any specific position on the board so that play may continue within a specified time limit rather than be limited by the number of board positions. Points are awarded for each of the positions a player controls at the end of the game. The player with the most points after the specified time limit has elapsed, wins the game.

BRIEF DESCRIPTION OF THE DRAWING

The accompanying drawing discloses the following components appropriate for the method of play of this invention.

Figure 1:
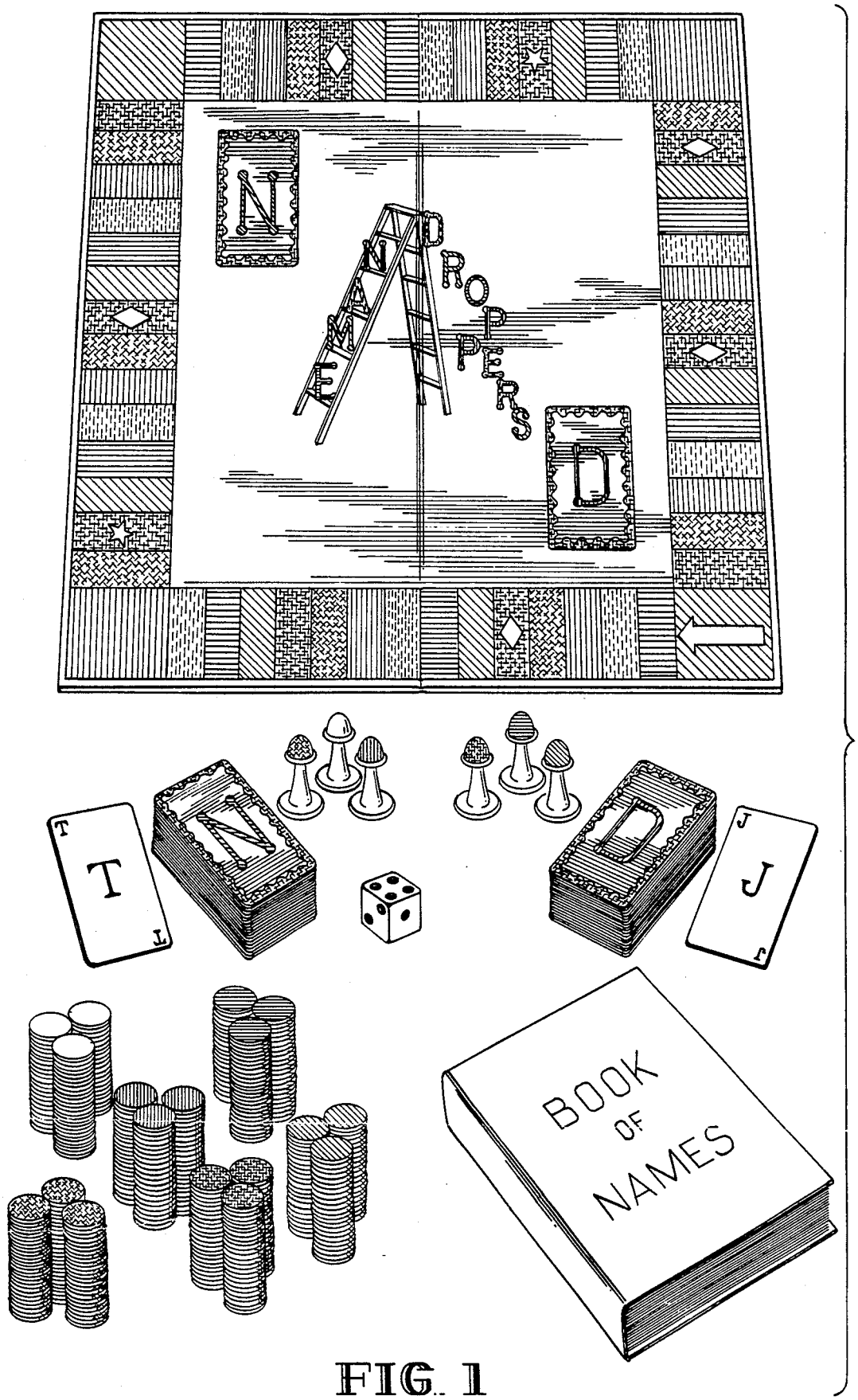
FIG. 1 illustrates.

A game board with a path of game squares demarcated upon it.

A variety of differently colored tokens to be moved about the board.

A standard six-sided die.

Two distinguishable decks of lettered cards.

Sets of scoring disks that correspond in color to the variety of tokens.

A reference book of famous names appropriate to the game.

DETAILED DESCRIPTION OF THE PREFERRED EMBODIMENT

The method of play disclosed by this invention begins with each of up to six players or teams of players selecting a differently colored token and receiving an allotment of appropriately colored scoring disks for that token. The number of scoring disks in each allotment is equal to the total number of positions on the board (fifty-nine) in the preferred embodiment. Players roll the die and the player rolling the highest number begins play. If two or more players tie, they roll again.

The game board should have a path of game squares printed on it. This path should be divided into distinct game squares, there being fifty-nine (59) in the preferred embodiment and one additional starting square.

All players begin with their tokens at the start position. The starting player rolls the die and moves his token the number of game squares indicated on the die. The player then draws two cards; one from a first deck known as the "first name deck" or "N" deck in the drawing, and one from a second deck known as the "last name deck" or "D" deck in the drawing.

Each of the two decks of cards should contain 105 cards, and each card should have an indication of which of the two decks it is from and on the opposite side should have a letter on it. In the preferred embodiment the decks should each contain the following cards:

| | |
|---|---|
| Letters A,B,C,E,D,F, G,H,J,K,L,M,P,R,S,T,W | 5 Cards |
| Letters K,N,O | 4 Cards |
| Letters I,V | 3 Cards |
| Letters U,Y | 2 Cards |
| Letters Q,X,Z | 1 Card |

These letters represent a first initial of a name if from the "first name deck" and a last initial of a name if from the "last name deck".

The player, having chosen two cards, then has thirty seconds to write down the name of a famous person whose initials match the letters chosen. If the player succeeds in naming someone, he controls the position upon which his token rests and places a disk from his allotment on the position to indicate that he now controls it. If the player is unable to name someone, the position remains uncontrolled.

The name that a player forms from the chosen initials must be found in a reference book of names associated with the game or in another reference book commonly agreed to by the players. The reference book in the preferred embodiment is entitled "The Book of Names That Count" and is an alphabetical compilation of thousands of famous names, past and present. The names are in the following five general areas:

(1) People in History (politics, military, education, business, law, etc.).
(2) Creative People (writers, artists, scientists, etc.).
(3) Fictional Characters (literature, movies, TV, etc.).
(4) Performing Artists (stage, screen, TV, recording, etc.).
(5) Sports Figures If all players agree that the name chosen is valid then there is no need to refer to the reference book. Any player may challenge the name given by the player attempting to acquire control of a board position. If such a "Name Challenge" is made, and the name does in fact appear in the reference book then the challenging player loses the highest point position (position point values are described below) that he controls and must remove his disk from that square. There is no penalty if the challenging player controls no squares. If the reference book does not contain the name, then the player challenged does not acquire control of the board position.

A player's turn ends after he either acquires, or fails to acquire, control of a position. The play then passes to the next player who proceeds as the first player.

When a player lands on a position that is already controlled by another player, the moving player challenges the controlling player to a one on one competition for the board position. This one on one competition begins, as does every attempt to control a position, by the moving player picking two cards, one from each deck to disclose a first and a last initial. The controlling player and the moving player then each write down the name of a famous person whose initials match the letters chosen. If the controlling player succeeds in naming someone and the moving player does not, then the controlling player retains control of the position. If the moving player succeeds in naming someone and the controlling player does not, then the moving player wins control of the position and replaces the disk on the position with one of his own. If the moving player and the controlling player each succeed in naming someone, or if neither succeeds, then there is no change and the controlling player retains control.

The game continues for a specific period of time, one hour in the preferred embodiment, but a longer amount of time may be agreed to. When the cards in each deck have all been played, they are shuffled and again placed face down for the continuation of play.

When the specified time period of play is up the players determine their point totals based on the number of positions on the board which they control. Each controlled square is worth a standard number of points with the exception of certain marked squares that are worth bonus points. In the preferred embodiment a standard position is worth ten points. There are five positions in the preferred embodiment, marked with diamonds, that are worth twenty points each and two positions in the preferred embodiment, marked with stars, that are worth forty points each.

The player with the most points wins the game.

There are a number of modifications to the preferred embodiment that allow alternative specialty games with the same basic structure to be played according to the disclosed method. Examples of these specialty games include a Sports version, a Performing Arts version, and a Politics version. Each of these embodiments involves modification only of the reference book and the field of names from which the players may choose.

I claim:

1. A method of playing a board game comprising the steps of:

providing a playing board having a playing path having a start square and a plurality of game squares;

providing a first deck of cards and a second deck of cards, the cards in each deck having indicia distinguishing said first deck of cards from said second deck of cards, each card in said first deck further comprising a letter representing a first initial of a name, each card in said second deck further comprising a letter representing a last initial of a name;

providing a plurality of differently colored player tokens, one for each player, a plurality of scoring disks corresponding in color to said player tokens, and a die;

allocating a player token and a plurality of similarly colored scoring disks to each player;

placing said player token on said start square;

each player's turn including, rolling the die, moving the token the indicated number of game squares, drawing one card from each deck, attempting to name a famous person having the initials on the drawn cards, if a player succeeds in a naming a famous person, that player controls the square occupied by the successful player's token, controlling said square by placing a scoring disk of said successful player on said square.

2. The method of claim 1 further comprising the step of:

if a player's token is moved to a square already controlled by another player's scoring disk, a card from each deck is drawn and the moving player and the controlling player both attempt to name a famous person having the initials on the drawn cards, if the controlling player succeeds in naming someone and the moving player does not, the controlling player retains the square, if moving player succeeds in naming someone and the controlling player does not, the moving player wins control of the square, if the moving player and the controlling player both succeed in naming someone or if neither succeed, the controlling player retains the square.

3. The method of claim 1 further comprising the step of:

writing down a famous person's name when attempting to name a famous person.

4. The method of claim 1 further comprising the step of:

providing a time limit for attempting to name a famous person.

* * * * *